US006371200B1

(12) United States Patent
Eaton

(10) Patent No.: US 6,371,200 B1
(45) Date of Patent: Apr. 16, 2002

(54) PERFORATED HEAT SINK

(75) Inventor: Deran S. Eaton, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/922,538

(22) Filed: Aug. 3, 2001

Related U.S. Application Data

(62) Division of application No. 09/443,120, filed on Nov. 18, 1999, now Pat. No. 6,110,306.

(51) Int. Cl.[7] ..... F28F 7/00; H05K 7/20

(52) U.S. Cl. ..... 165/80.3; 165/185; 165/104.33; 361/690

(58) Field of Search ..... 165/80.3, 185, 165/104.33; 361/690, 692, 702, 709, 697; 257/722; 415/115

(56) References Cited

U.S. PATENT DOCUMENTS 2,834,582 A * 5/1958 Kablitz ..... 165/185
4,541,004 A * 9/1985 Moore ..... 257/706
5,000,254 A * 3/1991 William ..... 165/80.3
5,049,982 A * 9/1991 Lee et al. ..... 257/722
5,224,538 A * 7/1993 Jacoby ..... 165/185
5,734,552 A * 3/1998 Krein ..... 165/80.3
5,854,739 A * 12/1998 Steiner et al. ..... 165/80.3
5,884,691 A * 3/1999 Batchelder ..... 165/80.3
5,915,463 A * 6/1999 Romero et al. ..... 165/80.3
6,201,699 B1 * 3/2001 Ayres et al. ..... 174/16.3
6,223,815 B1 * 5/2001 Kazuya ..... 165/185

FOREIGN PATENT DOCUMENTS

JP 200022364 * 1/2000

* cited by examiner

*Primary Examiner*—Henry Bennett
*Assistant Examiner*—Tho Van Duong
(74) *Attorney, Agent, or Firm*—Mark Homer

(57) ABSTRACT

A compact perforated heat sink having high heat dissipation has a substrate with a multitude of holes and a thermal conductive pathway to conduct heat from a heat source to the substrate. The surface area of the holes is equal to or greater than the surface area of the substrate without the holes.

15 Claims, 2 Drawing Sheets

PERFORATED HEAT SINK

This application is a division of pending application Ser. No. 09/443,120, filed Nov. 18, 1999 now U.S. Pat. No. 6,110,306.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention includes a perforated heat sink. More particularly, the present invention includes a compact heat sink having a plurality of holes within a substrate to thermally conduct heat away from a heat source. Most particularly, the holes within the compact heat sink increase the surface area of the substrate for dissipating heat by a factor of two from the substrate without the holes.

2. Brief Description of the Related Art

Types of known thermal management technologies include thermoelectric conduction (TEC), heat pipes, and extruded/bonded fin heat sinks.

Thermoelectric conduction uses DC electricity inside an active cooling device, typically having a finned heat sink sandwiched between two plates, with DC power driving the Peltier effect between the plates. As an active device, the thermoelectric conduction device may be made to function compactly and economically, however, power consumption is generally required on an order of amps at digital electronics voltages (3.3 VDC, 5 VDC) which is outside of the range of battery-driven applications.

Heat pipes are often found with liquid cooling systems, where the heat pipes provide passive fluid conduction. Heat pipes are often bulky and fragile unless embedded in a substrate, which is generally impractical for confined spaces.

Extruded/bonded fin heat sinks are the most common type of thermal management device, which sometimes uses an attached fan. Generally the fin configuration of these devices occupies too much physical volume to be practical in extremely confined spaces. The conventional fin arrays, because of their jagged shapes, frequently cause turbulent air patterns that unevenly cool parts of the heat sink and the device to which it attaches.

Several patents have addressed the use of heat sinks. U.S. Pat. No. 5,146,981 (Samarov) discloses a heat sink with a plurality of holes, however, these holes appear to be haphazardly placed within the heat sink and are covered at one end. U.S. Pat. No. 5,552,634 (Schneider) discloses a heat sink with a plurality of pegs that may form multiple layers. U.S. Pat. Nos. 5,814,536 and 5,869,891 (Rostoker et al.) disclose a heat sink with fins, holes, protrusions, and grooves or depressions to increase the surface area of the fins of a heat sink. U.S. Pat. No. 5734552 (Krein) discloses an inverted airfoil configuration for a heat sink, however, the disclosed airfoil does not use holes for heat dissipation. None of these references discloses a maximized surface area with holes for heat transfer into and away from the heat sink.

There is a need in the art to provide a compact, thermally conductive system for electronic systems. The present invention addresses this and other needs.

SUMMARY OF THE INVENTION

The present invention includes a compact perforated heat sink having high heat dissipation consisting essentially of at least one substrate forming a plurality of holes therein, wherein the surface area of the substrate with the holes is equal to or greater than the surface area of the substrate without the holes, wherein heat flows through the holes, and means for thermal conductivity attached to the substrate capable of conducting heat away from a heat source into the substrate.

The invention further includes a perforated heat sink, in the shape of an airfoil, having high heat dissipation consisting essentially of at least one substrate having a first side and second side forming an airfoil having a leading edge and trailing edge, the substrate forming a plurality of holes therein, wherein the surface area of the substrate with the holes is equal to or greater than the surface area of the substrate without the holes, wherein heat flows through the holes, and means for thermal conductivity attached to the at least one substrate capable of conducting heat from a heat source to the at least one substrate and means for creating a substantially unidirectional fluid flow onto the leading edge, wherein lift is created within the plurality of holes.

Additionally, the present invention includes a method for dissipating heat from an electronic component, comprising the step of providing a compact perforated heat sink having high heat dissipation consisting essentially of at least one substrate forming a plurality of holes therein, wherein the surface area of the substrate with the holes is equal to or greater than the surface area of the substrate without the holes, wherein heat flows through the holes, and means for thermal conductivity attached to the at least one substrate capable of conducting heat from a heat source to the at least one substrate and conducting heat into the substrate through the means for thermal conductivity wherein the heat dissipates through the holes.

Furthermore, the present invention includes a dissipated heat product formed by the process comprising the steps of providing a compact perforated heat sink having high heat dissipation consisting essentially of at least one substrate forming a plurality of holes therein, wherein the surface area of the substrate with the holes is equal to or greater than the surface area of the substrate without the holes, wherein heat flows through the holes, and means for thermal conductivity attached to the at least one substrate capable of conducting heat from a heat source to the at least one substrate and conducting heat into the substrate through the means for thermal conductivity wherein the heat dissipates through the holes.

A composite heat sink may be formed from a plurality of compact perforated heat sinks, such as in a stacked formation including thermally conductive standoffs. The compact heat sinks may be used in any appropriate device, and are particularly useful in electronics systems.

DETAILED DESCRIPTION OF THE PREFERRED EMBODIMENT

The present invention includes a perforated heat sink that is particularly useful in compact spaces. The perforated heat sink significantly increases the surface area of heat dissipation without the necessity of increased size that would be detrimental to use in compact systems. Holes within the structure of the heat sink at least double the surface area of thermal dissipation while permitting sufficient area between the holes to ensure proper heat flow within the heat sink. As the surface area of the compact heat sink thermally conducts heat away from a heat source, heat within the heat sink is uniformly maintained. The present invention is particularly useful in the United States Navy's Extended Range Guided Munition Smart Trainer (ERGM-ST), manufactured by Naval Sea Systems Command, Indian Head Division of Indian Head, Maryland, more particularly when mated with multiple TO-220 (or similar) electronics packages of UA7805 power regulators that channel 9 VDC and 12 VDC power into 5 VDC at approximately 1.00 A.

Figure 1:
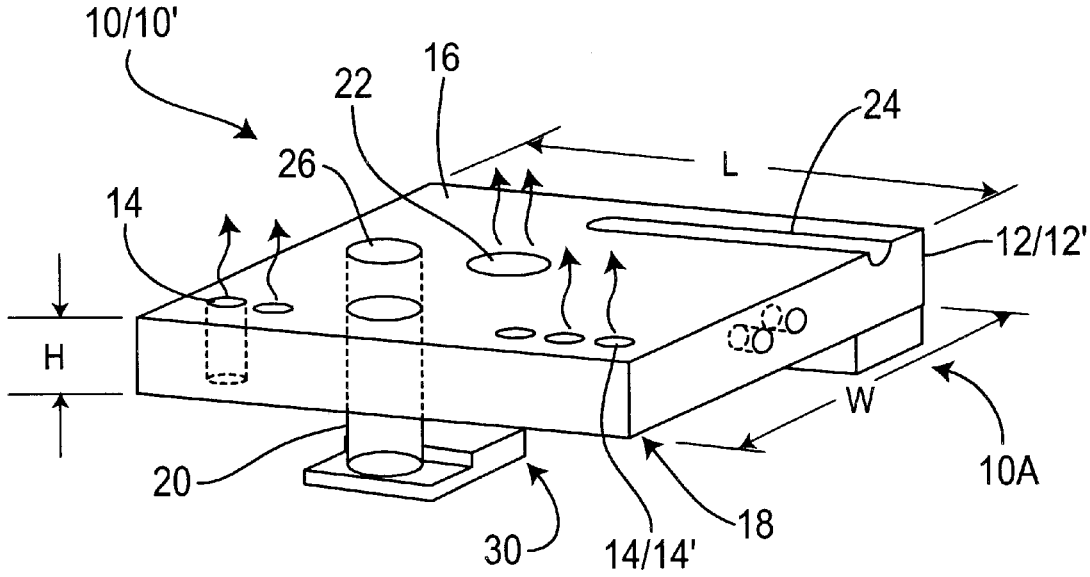
FIG. 1 illustrates a heat sink of the present invention, with an ERGM-ST application of the heat sink having a single heat sink to cool two TO-220 devices shown in a bottom view illustration in FIG. 1A; and, FIG. 2 illustrates a composite heat sink utilizing multiple heat sinks of FIG. 1 that have airfoil designs, with FIGS. 2A and 2B showing the airflow of the airfoil design.

As seen in FIG. 1, a compact perforated heat sink 10 of the present invention includes at least one substrate 12 having a plurality of holes 14 within the substrate 12. The holes 14 within the perforated heat sink 10 increase the surface area 12' of the substrate 12 by at least a factor of two. With the holes 14, the added hole surface area 14' of the holes 14 in the perforated heat sink 10 is equal to or greater than the substrate surface area 12' of the substrate 12 without the holes 14. The holes 14 are arranged in an extremely efficient, geometrically planned heat transfer configuration, described below, that permits a high heat dissipation without increasing the size of the perforated heat sink 10.

The heat sink 10 dissipates the accumulated heat from a heat source 30. The heat source 30 preferably comprises an electrical system or component, such as a chip, circuit board, and the like, that is located in a confined space. As the component, i.e., heat source 30, emits heat within the confined space, the heat must be dissipated from the confined space to prevent deterioration of chip performance within the electrical system. The heat sink 10 cools the chip through a,heat transfer medium or means for thermal conductivity 20, which is physically attached, and thermally connected, to the chip. With the heat source 30 attached to the means for thermal conductivity 20, which in turn is attached to the substrate 12, heat is transferred from the heat source 30 to the substrate 12. The means for thermal conductivity 20 conducts heat from, and away from, the heat source 30 into the substrate 12 of the heat sink 10. The means for thermal conductivity 20 includes thermally conductive bridges or pathways, standoffs, attached substrates, and other like devices which may be selected by those skilled in the art. The means for thermal conductivity 20 may also include mounting screws 22 within mounting holes 26 which mount the heat source 30 to the heat sink 10, with the mounting screws 22 possessing thermal conductivity to transfer heat from within the electrical system to the heat sink 10 to dissipate the heat. Once heat has transferred from the heat source 30 to the heat sink 10, the heat sink 10 dissipates heat into a fluid medium, which may include any known heat transfer fluid medium, including for example, air and gases (including forced air), and liquids such as water, anti-freeze and the like. The fluid medium may be flowed, forced or otherwise transited across and/or against the present invention for proper heat conduction.

Preferably, the heat sink 10 has opposing sides, such as a first side 16 and second side 18, with the holes 14 formed and extended therein. More preferably, the holes 14 extend from the first side 16 to the second side 18 of the substrate 12, allowing an open conduit between the two sides 16 and 18. The plurality of holes 14 are preferably formed substantially perpendicular to both the first side 16 and the second side 18 of the substrate 12. The diameter of each hole 14 is preferably substantially equal to the other holes 14, with the holes 14 separated from each other by a distance of at least fifty percent of the diameter of the holes 14. Additionally, the holes 14 are placed at least a distance of the diameter of a hole 14 away from the mounting holes 26 and no hole 14 is placed within a distance of the diameter of a hole 14 to any substrate 12 edge. This configuration of the holes 14 allows efficient thermal conductivity and structural integrity within the substrate 12 while at least doubling the surface area 12' of the substrate 12 with the added surface area 14' of the holes 14. Efficiency of the thermal conductivity and structural integrity are further enhanced within the substrate 12 with the holes 14 separated from any side edge by a distance of at least equal to or greater than the diameter of the holes 14.

Calculation of the total surface area 10' of the heat sink 10, i.e., the surface area 12' of the substrate 12 with the added surface area 14' of the holes 14, is derived from equation 1, below:

$$\text{Total Surface Area}_{Heat\ Sink} = tSA_{plate} - SAR_M - SAR_P + SAX_P \quad (1)$$

where:

$tSA_{plate}$ is the total surface area of the substrate 12 without holes, with $tSA_{plate}=2(HL+HW+LW)$, with H, L and W defined as the height, length, and width, respectively;

$SAR_M$ is the surface area removed for the mounting holes, with $SAR_M=N_M\pi r_M^2$, with $N_M$ being the number of mounting holes 26, and $r_M$ being the mount hole 26 radius. Only half the surface area is used to account for the covering with mounting screws on the top side of the mounting holes 26. Heat transfer occurs through the hole but as a factor of the covering screw 22, not the mounting hole 26.

$SAR_P$ is the surface area removed with the formation of the holes 14, where $SAR_P=2N_P\pi r_P^2$, with $N_P$ being the number of holes 14, and $r_P$ being the hole 14 radius (generally the hole radius 14 is about 25% of the mounting hole (M) radius); and, $SAX_P$ is the increase surface area exposed from the holes 14, where $SAX_P=2r_P\pi H$ for round holes 14, with the surface area calculation changed for different hole 14 geometries with such calculations determinable by those skilled in the art.

The substrate 12 comprises any suitable thermally conductive material, preferably a metal material, with the proper selection of material determinable by those skilled in the art. More preferably, the metal material of the substrate 12 comprises a thermally conductive metal of aluminum, copper, steel, brass or combinations thereof. Most preferably, the conductive material comprises aluminum.

The heat sink 10 may include additional heat dissipating components 24 that do not interfere with, and preferably increase, the efficient function of the heat sink 10. These heat dissipating components 24 in the heat sink 10 may include grooves, different hole 14 geometries, or other like recesses in the substrate 12 for heat dissipation, and/or compartment area fit, of the heat sink 10, as determined by those skilled in the art. Grooves may be routed, extruded or molded into the heat sink 10. Projections and types of extensions, such as fins, may also be included in the heat sink 10 in a manner that does not interfere with the proper functioning of the heat sink 10, i.e., the fins may compliment the heat dissipation features of the heat sink 10. Additionally, the shape of all or part of the heat sink 10 may comprise any appropriate shape for use within a confined, i.e., compact, space, such as a sphere, cylinder, or other configuration, with the proper form, dimensions, type, size, and other shape characteristics of the heat sink 10 being determinable by those skilled in the art. Use of the heat dissipating components 24 are used in a non-interfering manner with the hole 14 in the substrate 12, i.e., the holes 14 are not intersected or altered with the heat dissipating components 24 such that the increased area increases the surface area to less than 50% of the non-altered substrate 12.

Figure 1A:
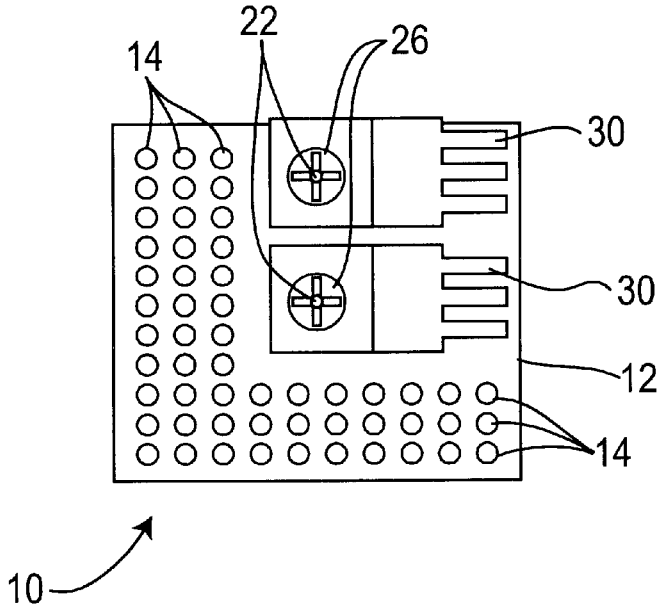

A preferred embodiment of the heat sink 10 of FIG. 1 is shown in FIG. 1A, which illustrates the heat sink 10 applied to the ERGM-ST with combination of a single heat sink 10 to cool two TO-220 devices 30. For use in the ERGM-ST, the heat sink 10 comprises an aluminum substrate 12 having a height (H) of approximately 0.123 inches (0.318 cm), a width (W) of approximately 0.750 inches (1.905 cm) and a length (L) of approximately 1.00 inches (2.540 cm). The holes 14 measure approximately 0.025 inches (0.064 cm) in diameter, with the mounting holes 26 measuring approximately 0.120 inches (0.305 cm) in diameter.

Figure 2:
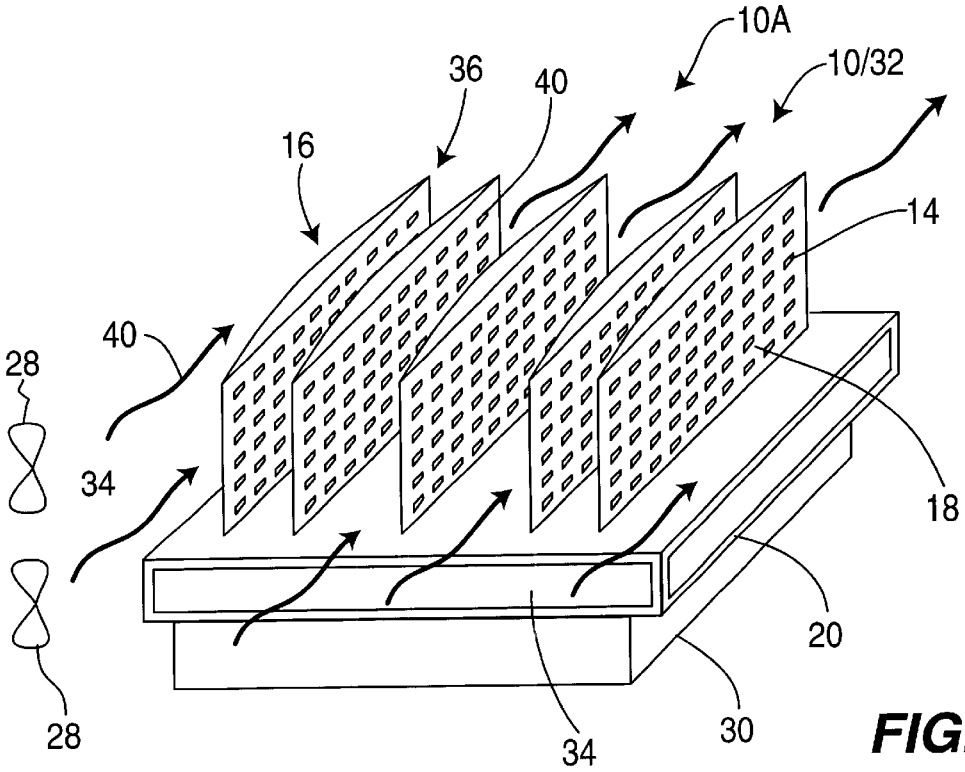

As seen in FIG. 2, a composite heat sink 10A may be formed from a plurality of perforated heat sinks 10 in the form of an airfoil, which preferably are stacked, and more preferably stacked with thermally conductive standoffs 20. Stacking the airfoil 10 greatly enhances the performance of the individual heat sinks 10. The heat sink 10 or composite heat sink 10A allows servicing of multiple heat sources 30 scaled to accommodate a single or multiple thermally conductive standoffs 20 or a like number of mounting holes 26 for connecting multiple heat sources 30. Even dispersion of heat across several heat sinks 10 increases the reliability of the heat source 30, i.e., electronics.

Figure 2A:
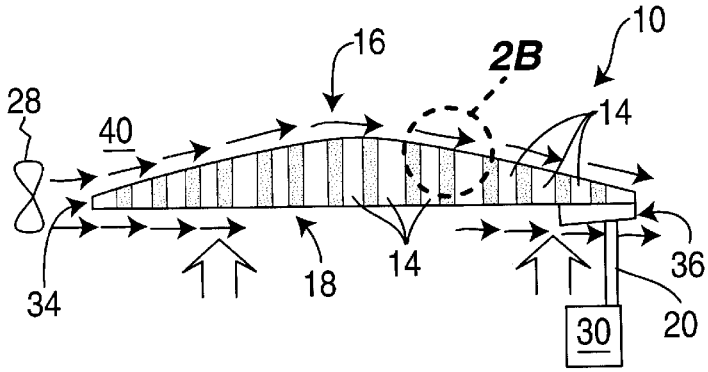
Figure 2B:
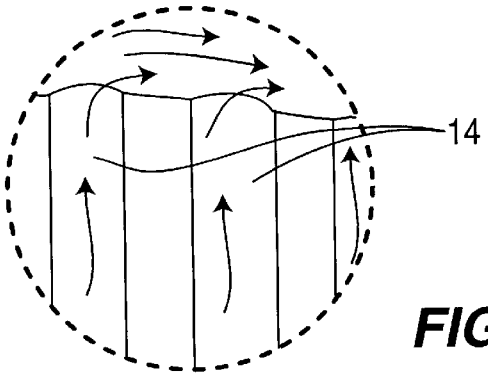

As further seen in FIGS. 2 and 2A, the preferred embodiment the heat sink 10 comprises the shape of an airfoil having the plurality of holes 14 extending through the cross-section of the airfoil. The airfoil heat sink 10 comprises a substrate 12 that is formed between a leading edge 34 and trailing edge 36 with a means for creating a substantially unidirectional fluid flow 28 of a fluid medium 40 onto the leading edge 34 of the airfoil 10 to create lift within the plurality of holes, using Bernoulli's Law to increase convection. As shown in FIGS. 2A and 2B, differential fluid pressure such as air pressure, or lift, is caused by a low-pressure zone being created on the first side 16 or curved surface of the airfoil where the air 40 (or other suitable fluid medium 40) is traveling faster than the air on the second side 18 or straight surface of the airfoil 10. This causes the pressure on the first side 16 to drop, creating lift. Surrounding fluid medium 40 flows up through the holes 14 from the pressure differential, adding in the heat dissipation of the airfoil heat sink 10. The lift effect removes heat away from the heat sink 10, while increasing contact of the heat sink 10 with cooler fluid medium 40. The airfoil 10 may be placed in any suitable location and/or position to cool the heat source 30, with the proper orientation of the airfoil 10 determinable by those skilled in the art in light of design constraints on spacing, compartment size, fluid flow, adhesion/contact to the heat source 30, and other like factors. The means for creating a substantially unidirectional fluid flow 28 may include fans for air or gases, pumps and/or nozzles for liquids such as water, gravitational designs, or other similar known devices or methods used to force unidirectional flow of fluid medium 40 against the leading edge 34 of the airfoil 10. The airfoil 10 generates a smoother and more uniform flow than conventional fin designs.

In use, the heat sink 10 receives heat from a circuit board 30 through aluminum standoffs 20. The heated heat sink 10 heats the air 40 within the holes 14, causing the air 40 within the holes 14 to rise, shown in FIG. 2B. The mounting screws 22 (shown in FIG. 1A) also dissipate heat. The rising warm air 40 generates convection that pulls cool air 40 through the holes 14, where the incoming cool air 40 is heated and rises. A continuous cycle is formed as long as the heat sink 10 remains heated. Conducting heat from the heat source 30 into the heat sink 10 produces rapid heat reduction within the heat source 30 while maintaining the structural integrity of the heat sink 10, without the necessity of using fans or other such devices.

In use, the heat sink 10 receives heat from a circuit board 30 through aluminum standoffs 20. The heated heat sink 10 heats the air 40 within the holes 14, causing the air 40 within the holes 14 to rise, shown in FIG. 2B. The mounting screws 26 also dissipate heat. The rising warm air 40 generates convection that pulls cool air 40 through the holes 14, where the incoming cool air 40 is heated and rises. A continuous cycle is formed as long as the heat sink 10 remains heated. Conducting heat from the heat source 30 into the heat sink 10 produces a rapid heat reduction within the heat source 30 while maintaining the structural integrity of the heat sink 10, without the necessity of using fans or other such devices.

EXAMPLES

The heat sink of the present invention (with approximately 200 holes) was tested against conventional heat sinks. A comparable conventional fin-type heat sink, a Sylvania-type ECG 402 TO-220 aluminum heat sink, was used as a control. Temperatures were recorded using a Dallas Semiconductor DS1621 electronic temperature sensor (thermometer), with associated software running under Window 95. The thermometer had a nominal upper sensor limit of 262.4° F. (128° C.). Times were measured with a stopwatch for cool down time and boiling time. The surface area of the heat sink of the present invention was approximately 1.84 $in^2$ (4.67 $cm^2$) and the surface area of the conventional heat sink was approximately 1.904 $in^2$ (4.84 $cm^2$). The surface area to volume ratio of the present invention was approximately 19.6 to 1 and approximately 13.02 to 1 for the conventional heat sink. The size of the heat sink of the present invention was approximately 0.094 $in^3$ (1.169 $cm^3$) and the size of the conventional heat sink was approximately 0.146 $in^3$ (2.397 $cm^3$). The average diameter of the holes was 0.025 in (0.064 cm). The heat sinks were affixed parallel to UA7805 power regulators for testing. Ambient temperature was 72.5° F. (22.5° C.).

With the UA7805 power regulators energized at 9 VDC, 1A, the temperature was measured at increasingly closer distances to the broadest side of the heat sink under test. Three distances were chosen for measurement, at 0.250 in., at 0.125 in., and in physical contact with the heat sink. The sensor was held for 10 seconds at each location. The results of the test are shown in Table 1, below.

TABLE 1

| DISTANCE (Sensor to Heat Sink) | Heat Sink 200 holes (Present Invention) | Conventional Heat Sink (Prior Art) |
|---|---|---|
| 0.250 inches | 88.7° F. (31.5° C.) | 82.4° F. (28.0° C.) |
| 0.125 inches | 145.4° F. (63.0° C.) | 117.5° F. (47.5° C.) |
| Physical Contact | 203.9° F. (95.5° C.) | 203.9° F. (95.5° C.) |

Warmer temperatures, at equal sensory distances, recorded for the heat sink of the present invention showed increased efficiency over the conventional heat sink. As expected, contact temperatures (with the energized UA7805) for the two heat sinks were equal. The heat sink of the present invention was shown to be more efficient for drawing heat from the heat source.

Water Droplet Test

The physical contact temperature was identical per the sensor software's threshold before the DS1621 stopped responding. For further confirmation, a water droplet test was conducted. Water boils at 212° F. (100° C.).

Onto each hot heat sink, a drop of tap water was place on the broad side of the heat sink with the time of boil recorded. The heat sink of the present invention boiled the water in 12 seconds, and the conventional heat sink boiled the water in 14 seconds.

The Water Droplet Test showed the heat sink of the present invention dissipating more energy over a given period of time.

Cool Down Test

With the UA7805 shut off, the heat sink of the present invention cooled enough to handle in 1 minute 19 second (corners after 1 minute), and the conventional heat sink was cool enough to handle in 1 minute 20 seconds (edges after 1 minute 9 seconds).

The heat sink 10, with greater compactness, was shown to dissipate heat as efficiently, or more efficiently, as a conventional heat sink. Heat sinks 10 may also be used in tighter spaces with equal or greater efficiency than conventional heat sinks. The heat sink 10 is easily manufactured, such as molded or extruded in any desired geometry and thickness, easy to scale with one or multiple heat sources 30 and generally possesses a smaller footprint, such as 0.144 $in^2$ (0.461 $cm^2$) for the TO-220, for installation. The heat sink 10 accommodates a greater number of heat sources 30 for a confined space.

The foregoing summary, description, and examples of the present invention are not intended to be limiting, but are only exemplary of the inventive features which are defined in the claims.

What is claimed is:

1. A compact perforated heat sink having high heat dissipation consisting essentially of:

at least one substrate forming a plurality of holes therein, wherein the surface area of the substrate with the holes is equal to or greater than the surface area of the substrate without the holes;

means for thermal conductivity attached to the at least one substrate capable of conducting heat from a heat source to the at least one substrate; and, means to create unidirectional flow of air through the holes comprising a shape having an airfoil with top and bottom sides, both having surface areas, wherein the surface area of the top is greater than the surface area of the bottom.

2. The perforated heat sink of claim 1, wherein the holes extend from a first side of the substrate to a second side of the substrate.

3. The perforated heat sink of claim 1, wherein the substrate comprises a conductive material selected from the group consisting of aluminum, copper, steel and brass.

4. The perforated heat sink of claim 3, wherein the conductive material comprises aluminum.

5. The perforated heat sink of claim 2, wherein the plurality of holes are formed substantially perpendicular to both the first side and the second side of the substrate.

6. The perforated heat sink of claim 1, wherein the diameter of each hole is substantially equal to the other holes.

7. The perforated heat sink of claim 1, wherein the holes are separated from each other by a distance of at least 50 percent of the diameter of the holes.

8. The perforated heat sink of claim 7, wherein the holes are separated from any side edge by a distance of at least equal to or greater than the diameter of the holes.

9. The perforated heat sink of claim 1, further comprising a means for creating fluid flow.

10. A composite heat sink comprising a plurality of perforated heat sinks of claim 1.

11. The composite heat sink of claim 10, wherein the plurality of heat sinks are stacked.

12. The composite heat sink of claim 11, wherein the stacked plurality of heat sinks are stacked with thermally conductive standoffs.

13. An electronics system comprising at least one perforated heat sink of claim 1.

14. A method for dissipating heat from an electronic component, comprising the steps of:

providing a compact perforated heat sink having high heat dissipation consisting essentially of at least one substrate forming a plurality of holes therein, wherein the surface area of the substrate with the holes is equal to or greater than the surface area of the substrate without the holes, means for thermal conductivity attached to the at least one substrate capable of conducting heat from a heat source to the at least one substrate, and, means to create unidirectional flow of air through the holes comprising a shape having an airfoil with top and bottom sides, both having surface areas, wherein the surface area of the top is greater than the surface area of the bottom;

conducting air flow into the substrate through the means for thermal conductivity wherein the air flow contacts the top and bottom sides and the holes of the substrate.

15. A dissipated heat product formed by the process comprising the steps of:

providing a compact perforated heat sink having high heat dissipation consisting essentially of at least one substrate forming a plurality of holes therein, wherein the surface area of the substrate with the holes is equal to or greater than the surface area of the substrate without the holes, means for thermal conductivity attached to the at least one substrate capable of conducting heat from a heat source to the at least one substrate, and, means to create unidirectional flow of air through the holes comprising a shape having an airfoil with top and bottom sides, both having surface areas, wherein the surface area of the top is greater than the surface area of the bottom;

conducting air flow into the substrate through the means for thermal conductivity wherein the air flow contacts the top and bottom sides and the holes of the substrate.

* * * * *